US009881579B2

(12) United States Patent
Oh et al.

(10) Patent No.: US 9,881,579 B2
(45) Date of Patent: Jan. 30, 2018

(54) LOW NOISE SENSITIVITY SOURCE DRIVER FOR DISPLAY APPARATUS

(71) Applicant: SILICON WORKS CO., LTD., Daejeon-si (KR)

(72) Inventors: Kwang Il Oh, Daejeon-si (KR); Yun Tack Han, Anyang-si (KR); Hyun Kyu Jeon, Daejeon-si (KR)

(73) Assignee: SILICON WORKS CO., LTD., Daejeon-si (KR)

( * ) Notice: Subject to any disclaimer, the term of this patent is extended or adjusted under 35 U.S.C. 154(b) by 205 days.

(21) Appl. No.: 14/224,915

(22) Filed: Mar. 25, 2014

(65) Prior Publication Data

US 2014/0292742 A1 Oct. 2, 2014

(30) Foreign Application Priority Data

Mar. 26, 2013 (KR) ..... 10-2013-0031829
Mar. 17, 2014 (KR) ..... 10-2014-0030914

(51) Int. Cl.
*G09G 5/00* (2006.01)
*G09G 3/36* (2006.01)

(52) U.S. Cl.
CPC ..... *G09G 3/3688* (2013.01); *G09G 5/008* (2013.01)

(58) Field of Classification Search
CPC ..... G09G 3/3696
See application file for complete search history.

(56) References Cited

U.S. PATENT DOCUMENTS 5,111,210 A * 5/1992 Morse ..... G01S 3/16 342/147
5,208,719 A * 5/1993 Wei ..... H03K 19/00315 257/355
5,528,682 A * 6/1996 Cotreay ..... H03H 7/01 333/101
2006/0157001 A1* 7/2006 Rahman ..... F01P 11/14 123/41.15
2006/0267876 A1* 11/2006 Jang ..... G09G 3/298 345/68
2009/0045759 A1* 2/2009 Kang ..... G09G 3/342 315/307
2010/0045590 A1* 2/2010 Kumamoto ..... G02F 1/13452 345/102

(Continued)

FOREIGN PATENT DOCUMENTS

JP 2004-356777 12/2004
KR 10-2007-0038412 4/2007

(Continued)

*Primary Examiner* — William Boddie
*Assistant Examiner* — David Lee
(74) *Attorney, Agent, or Firm* — Kile Park Reed & Houtteman PLLC

(57) ABSTRACT

Disclosed is a source driver for a display apparatus which is insensitive to power noise, and a configuration of filtering an influence of power noise, which is introduced from an exterior of the source driver or occurs in an interior thereof, to an operation of the source driver. The present invention is applied to the case of receiving a clock signal and a data signal through the single signal line, and is embodied such that a source driver for driving a display apparatus for achieving a high speed operation and a large screen has a characteristic insensitive to power noise.

17 Claims, 14 Drawing Sheets

(56) References Cited

U.S. PATENT DOCUMENTS

| | | | | |
|---|---|---|---|---|
| 2010/0045651 | A1* | 2/2010 | Kim | G09G 3/3696 345/212 |
| 2011/0012582 | A1* | 1/2011 | Aisu | G05F 1/575 323/314 |
| 2011/0128071 | A1* | 6/2011 | Fukusen | H03H 11/1291 327/554 |
| 2011/0242066 | A1* | 10/2011 | Jeon | G09G 3/20 345/204 |
| 2011/0286562 | A1* | 11/2011 | Jeon | G09G 3/20 375/371 |
| 2011/0311010 | A1 | 12/2011 | Huang et al. | |
| 2013/0285998 | A1* | 10/2013 | Hong | G06F 3/038 345/212 |

FOREIGN PATENT DOCUMENTS

| | | |
|---|---|---|
| KR | 10-2008-0003735 | 1/2008 |
| KR | 10-2008-0041334 | 5/2008 |
| KR | 10-2010-0076243 | 7/2010 |
| KR | 10-2011-0017275 | 2/2011 |
| KR | 10-2011-0132308 | 12/2011 |
| KR | 10-2012-0091858 | 8/2012 |

* cited by examiner

LOW NOISE SENSITIVITY SOURCE DRIVER FOR DISPLAY APPARATUS

BACKGROUND OF THE INVENTION

Field of the Invention

The present invention relates to a display apparatus, and more particularly, to a source driver for a display apparatus, which stably performs a function of processing display data at a high speed and achieving a large screen and is insensitive to power noise.

Description of the Related Art

As a display apparatus for displaying an image, a liquid crystal display apparatus has been extensively used.

A conventional liquid crystal display apparatus includes a timing controller that processes a data signal and generates a timing control signal, and a panel driving unit that drives a display panel by using the data signal and the timing control signal transmitted from the timing controller.

The panel driving unit includes a source driver that processes the data signal and a gate driver that controls a source driving signal to be driven to the display panel. Each of the timing controller, the source driver, and the gate driver may be prepared in the form of an integrated circuit.

The source driver concentrically outputs a voltage for displaying an image to the display panel at a specific time in terms of operation characteristics thereof. The source driver has a large number of output ports for driving data lines of the display panel. That is, the source driver concentrically outputs the voltage for displaying an image from the large number of output ports at the specific time. Therefore, when the display panel is driven, power noise occurs in the source driver. The power noise occurring in an interior as described above or power noise introduced from an exterior may have an influence on the operation of the source driver.

In the conventional liquid crystal display apparatus, the transmission speed of the data signal from the source driver is not fast, and the size of the display pane is small. Therefore, the source driver has no difficulty of detecting the data signal regardless of the aforementioned power noise, and it is not probable that an abnormal operation is performed.

Furthermore, in the conventional liquid crystal display apparatus, a clock signal necessary for detecting the data signal is also transmitted to the source driver from the timing controller through an independent signal line. In this regard, the source driver has a characteristic tolerant to the power noise.

A large liquid crystal display apparatus having a high refresh rate needs to perform transmission/reception of a data signal between the timing controller and the source driver at a high speed. To this end, the liquid crystal display apparatus may use various interfaces, and for example, may use a clock embedded data signaling (CEDS) interface in which the clock signal has been embedded in the data signal. That is, the timing controller transmits a clock embedded data signal (hereinafter, referred to as a 'CED signal'), in which the clock signal has been embedded in the data signal, to the source driver.

In an interface environment employing the aforementioned CEDS scheme, the source driver receives the CED signal, recovers the clock signal and the data signal from the CED signal, processes the data signal by using the recovered clock signal, and outputs a source driving signal. However, in the aforementioned interface environment employing the CEDS scheme, the source driver has a problem that it is not tolerant to power noise.

When large power noise occurs in or is introduced to the source driver, it is probable that the source driver instantaneously performs an abnormal operation by the power noise in the process of recovering the clock signal from the CED signal and detecting the data signal.

The abnormal operation of the source driver by the power noise will be described in more detail below.

The liquid crystal display apparatus has several power sources, and particularly, has high voltage sources for driving the display panel.

These high voltage sources may be used for parts mounted on the same printed circuit board for different purposes, and power noise may occur when switching is performed in the parts by the high voltage sources.

For example, the liquid crystal display apparatus may have high voltage sources of 9 V, 4.5 V, 24 V and the like. The source driver has a clock-data recovery circuit therein for the CEDS interface. The clock-data recovery circuit recovers the clock signal and the data signal from the CED signal, and uses a relatively low voltage of 1.8 V at this time.

Even when power noise of about 10% of the high voltage source occurs, power noise of 0.9 V, 0.45 V, 2.4 V and the like may occur. When such power noise has an influence on the clock-data recovery circuit in the source driver, the clock-data recovery circuit may perform an abnormal operation such as abnormal detection of the data signal.

Particularly, the power noise may occur when the source driver concentrically outputs the source driving signal at a specific time in order to drive the display panel.

For example, when the output of an amplifier of the source driver using the high voltage source in order to output the source driving signal is transitioned from Low to High (for example, 9 V), power noise may occur in a ground voltage GND. When such power noise is introduced to the clock-data recovery circuit of the source driver, lock fail may occur in the clock-data recovery circuit.

A lock state indicates a state in which, when the clock signal recovered from the CED signal maintains a stable state, the clock signal in the recovered state is set to be continuously outputted. The lock fail indicates that the lock state is released by the influence of power noise even though the clock signal maintains a stable state.

In the case in which the aforementioned power noise is introduced, since the lock state is released by the lock fail even though the clock signal is stable, the source driver may perform an abnormal operation such as clock training for stabilizing of the clock signal.

For example, in the case in which the output voltage of the amplifier of the source driver is 9 V, even when power noise of 0.451 V, which corresponds to about 5% of the output voltage of the amplifier of the source driver, occurs, the aforementioned lock fail may occur in the clock-data recovery circuit of the source driver at a corresponding time point.

In this regard, the source driver needs to be designed to be insensitive to power noise in order to achieve a high speed operation and a large screen.

SUMMARY OF THE INVENTION

Accordingly, the present invention has been made in an effort to solve the problems occurring in the related art, and an object of the present invention is to provide a source driver for a display apparatus, which is insensitive to power noise introduced from an exterior or occurring in an interior.

Another object of the present invention is to provide a source driver for a display apparatus, which includes a clock-data recovery circuit having stability against power noise and is insensitive to the power noise.

Another object of the present invention is to provide a source driver for a display apparatus, which has a filter function corresponding to power noise in a CEDS interface scheme using a CED signal in which a clock signal has been embedded in a data signal and is insensitive to the power noise.

Another object of the present invention is to provide a source driver for a display apparatus, which provides a filter function corresponding to the power noise to a clock recovery circuit in a clock-data recovery circuit sensitive to power noise or a delay circuit for delaying a recovered clock signal in the clock recovery circuit.

In order to achieve the above object, according to one aspect of the present invention, there is provided a source driver for a display apparatus including: a clock-data recovery circuit that receives a clock signal and a data signal transmitted through the single signal line and recovers the clock signal and the data signal, and a filter circuit that is connected to at least one of an operation voltage terminal and a ground voltage terminal electrically connected to the clock-data recovery circuit and filters power noise.

In order to achieve the above object, according to one aspect of the present invention, there is provided a source driver for a display apparatus including: at least one voltage terminal, a circuit that receives a signal including a clock signal and performs a preset operation by using the clock signal, and a filter circuit that is connected between the voltage terminal and the circuit and filters transfer of power noise to the circuit through the voltage terminal.

According to the present invention, the source driver is insensitive to external or internal power noise, so that the source driver can perform a normal operation even when power noise occurs.

Particularly, according to the present invention, it is possible to reduce an influence of externally introduced power noise to an operation of a clock-data recovery circuit, and to normally recognize a clock signal and a data signal.

Furthermore, according to the present invention, an influence of power noise to recovery of a clock signal from a CED signal based on a CEDS interface scheme can be filtered, so that it is possible to stably drive a high speed display apparatus with a large screen.

Furthermore, according to the present invention, a filter for filtering power noise may be applied to a clock recovery circuit sensitive to power noise in the clock-data recovery circuit or a delay circuit in the clock recovery circuit, so that it is possible to stabilize an operation of the source driver.

BRIEF DESCRIPTION OF THE DRAWINGS

The above objects, and other features and advantages of the present invention will become more apparent after a reading of the following detailed description taken in conjunction with the drawings, in which.

DETAILED DESCRIPTION OF PREFERRED EMBODIMENTS

Figure 1:
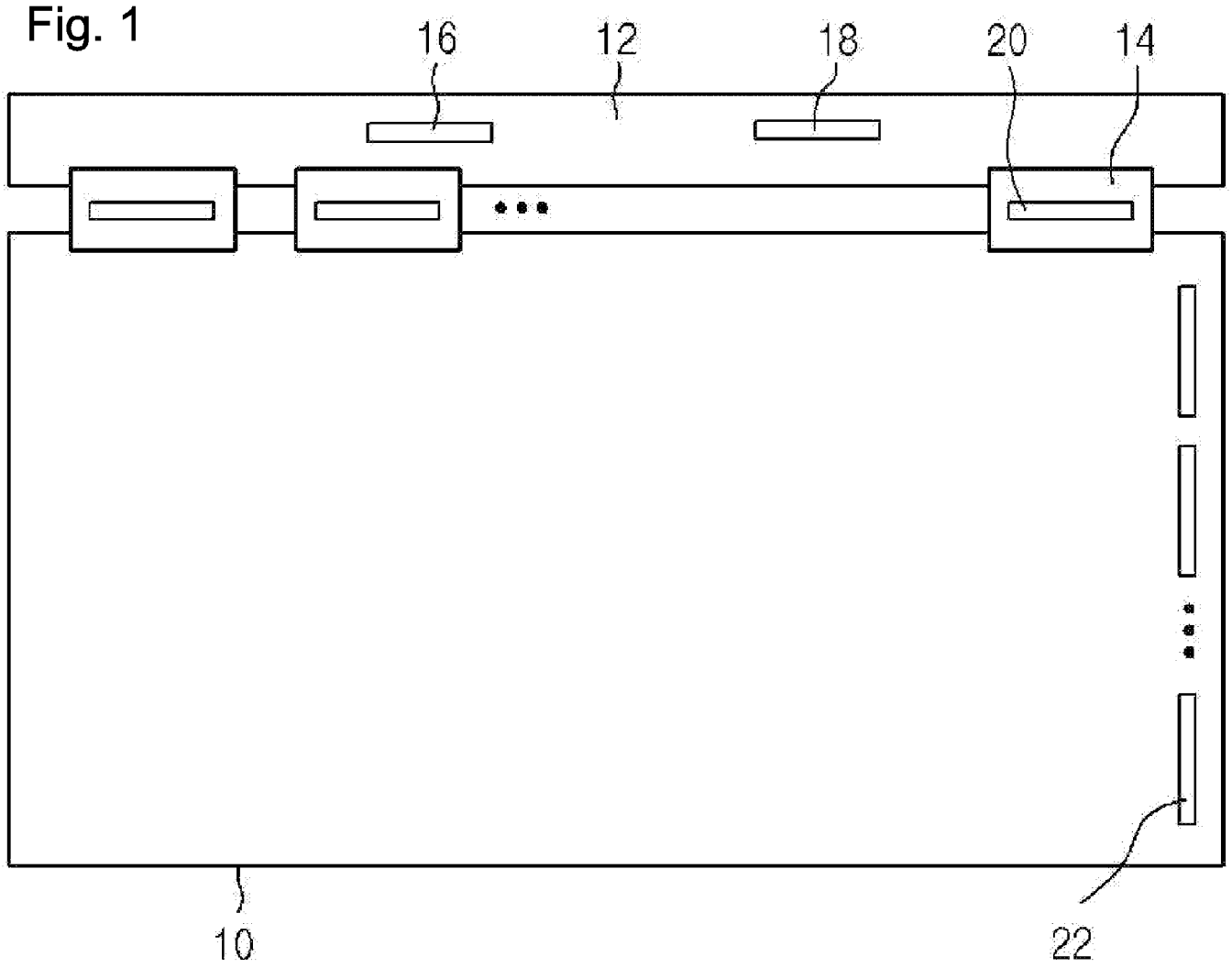
FIG. 1 is an arrangement diagram illustrating a general display apparatus.

Reference will now be made in greater detail to a preferred embodiment of the invention, an example of which is illustrated in the accompanying drawings. Wherever possible, the same reference numerals will be used throughout the drawings and the description to refer to the same or like parts.

Referring to FIG. 1, a display apparatus generally includes a display panel 10 and a printed circuit board 12. The display panel 10 may include a flat display panel such as an LCD (Liquid Crystal Display), an OLED (Organic Light Emitting Diode), or an LED (Light Emitting Diode). The display panel 10 of the present invention is prepared in the form of the LED.

The display panel 10 and the printed circuit board 12 may be electrically connected to each other through a film 14. The film 14 may include a source driver 20 mounted thereon, may be provided with a conductive pattern (not illustrative) for an electrical connection between the display panel 10 and the printed circuit board 12, and the surface, on which the source driver 20 has been mounted, of the film 14 may physically and electrically couple the display panel 10 and the printed circuit board 12 to each other through conductive adhesive.

The printed circuit board 12 may include a timing controller 16, a power management circuit 18 and the like mounted thereon.

In the embodiment of the present invention, it is possible to perform signal transmission between the timing controller 16 and the source driver 20 through a CEDS interface scheme. A CED signal includes a clock signal and a data signal having the same amplitude, the clock signal and the data signal of the CED signal are transmitted through the single signal line, and the clock signal periodically exists on the CED signal. The CED signal may have a structure in which the clock signal has been embedded in the data signal, and the data signal may include at least one of RGB data and control data. The RGB data indicates data for displaying a normal screen.

The timing controller 16 receives the data signal and the clock signal from an exterior. The timing controller 16 transmits the CED signal to the source driver 20. The CED signal may use a voltage of about 1.8 V. The timing controller 16 may provide a gate driver 22 with a gate clock and a gate driving signal.

The power management circuit 18 may generate various voltages such as 1.8 V, 9 V, or 4.5 V, and provide voltages necessary for the timing controller 16, the source driver 20, the gate driver 22 and the like.

The source driver 20 receives the CED signal from the timing controller 16, and provides a source driving signal to the display panel 10.

The gate driver 22 may be mounted on the display panel 10 by a chip-on-film method or a chip-on-glass method, receives the gate clock and the gate driving signal provided by the timing controller 16, and provides the gate driving signal to the display panel 10.

The display panel 10 may display an image by the source driving signal outputted from the source driver 20 and the gate driving signal of the gate driver 22.

In the aforementioned configuration, the source driver 20 may be configured to have the timing controller 16 therein, differently from the case of FIG. 1. In this case, the gate driver 22 may be configured to receive the gate clock and the gate driving signal from one of a plurality of source drivers 20. The source driver 20 may also receive the CED signal even in the case of having the timing controller 16 therein, and in this case, the CED signal may be transmitted to the source driver 20 by the CEDS interface scheme through the single signal line.

The aforementioned display apparatus uses various types of power, and the source driver 20 may be affected by power noise by various types of power.

Figure 2:
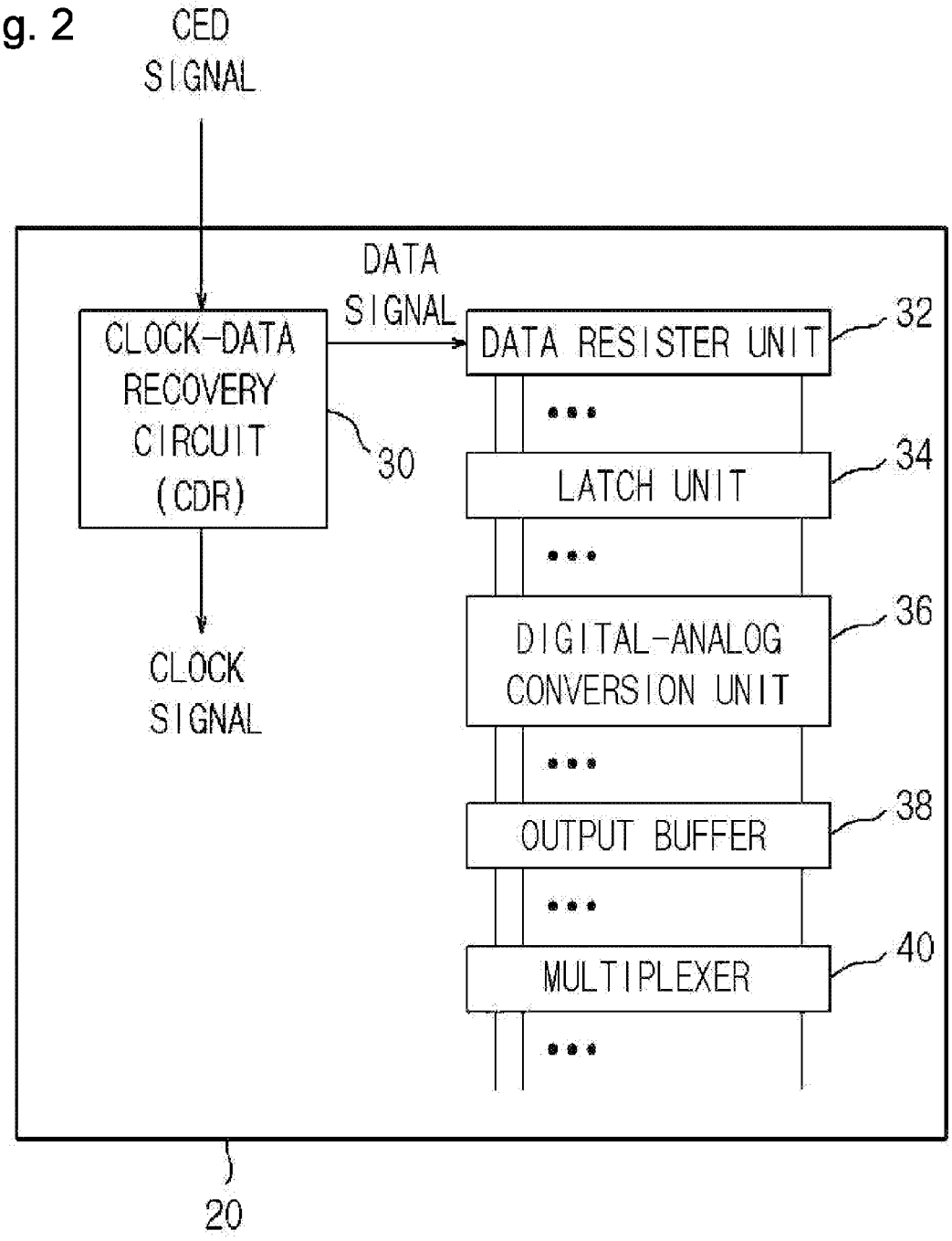
FIG. 2 is a block diagram illustrating a source driver according to an embodiment of the present invention.

The source driver 20 may be configured as illustrated in FIG. 2.

The source driver 20 may include a clock-data recovery circuit (CDR) 30, a data register unit 32, a latch unit 34, a digital to analog conversion unit 36, an output buffer 38, and a multiplexer 40.

The clock-data recovery circuit 30 has a configuration of receiving the CED signal, and recovering and outputting the data signal and the clock signal.

The data register unit 32 has a configuration of storing the data signal from the clock-data recovery circuit 30 by a predetermined amount such as a line unit, and outputting the stored data signal.

The latch unit 34 has a configuration of latching the data signal outputted from the data register unit 32 and transferring the data signal to the digital to analog conversion unit 36.

The digital to analog conversion unit 36 has a configuration of converting the data signal having a digital value to a voltage having an analog value for displaying an image.

The output buffer 38 has a configuration of driving the analog signal outputted from the digital to analog conversion unit 36 and outputting the source driving signal.

The multiplexer 40 has a configuration of selecting a signal to be applied to the display panel 10 from signals outputted from the output buffer 38.

As described above, since the clock-data recovery circuit 30, the data register unit 32, the latch unit 34, the digital to analog conversion unit 36, the output buffer 38, and the multiplexer 40, which constitute the source driver 20, have generally disclosed configurations, a description of detailed configurations and operations thereof will be omitted.

As described above, the clock-data recovery circuit 30 may receive the CED signal, recover the data signal and the clock signal by using the CED signal, and output the recovered data signal and clock signal.

The clock-data recovery circuit 30 has an operation voltage terminal to which an operation voltage Vcc of the power management circuit 18 is applied, and a ground voltage terminal to which a ground voltage GND of the power management circuit 18 is applied. The source driver 20 according to the embodiment of the present invention may include filter circuits provided to one or more of the Vcc terminal and the GND terminal as illustrated in FIG. 3.

Figure 3:
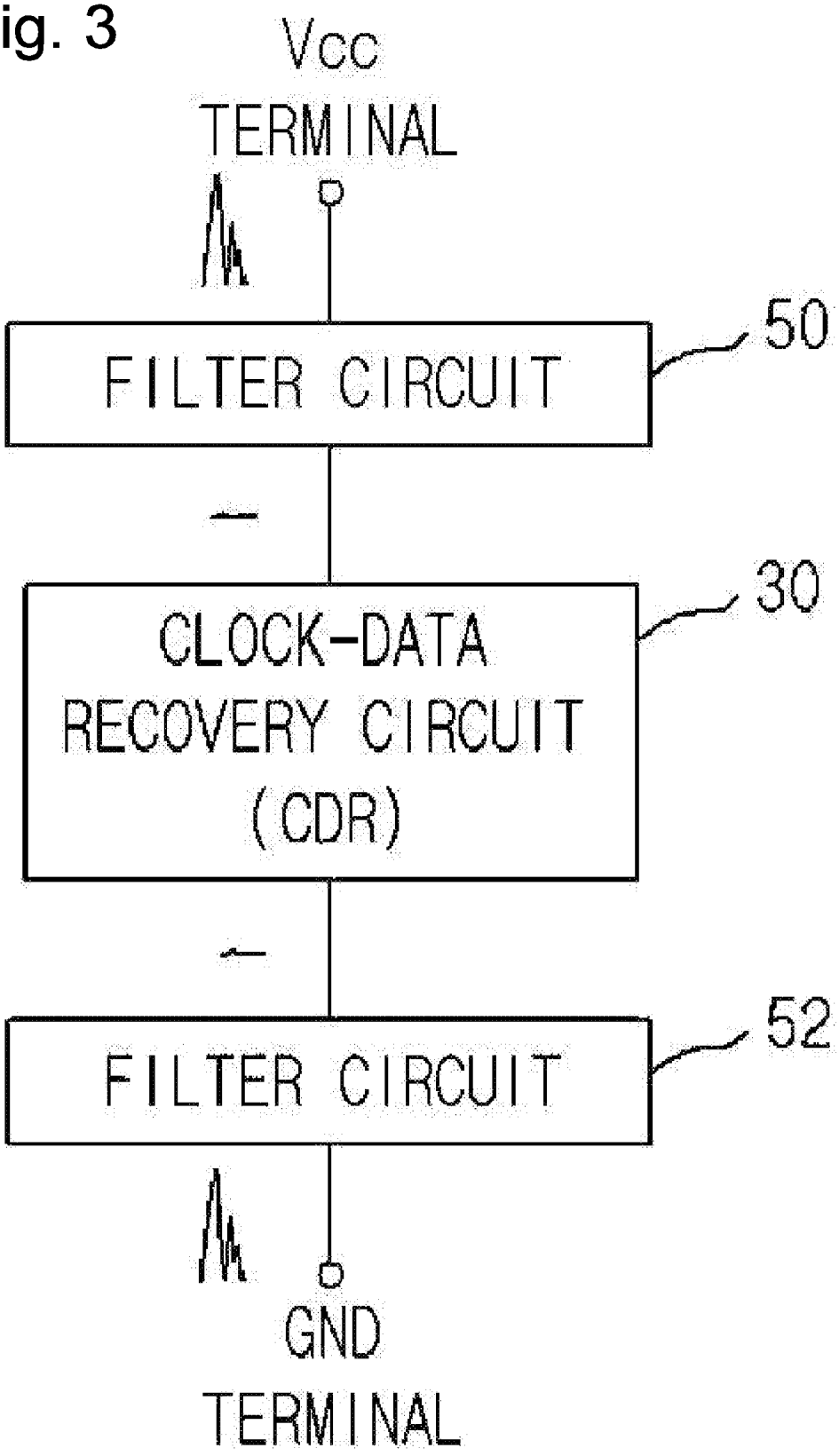
FIG. 3 is a block diagram illustrating a preferable embodiment in which a clock-data recovery circuit of FIG. 2 has a filter function.

In more detail, the source driver according to the embodiment of the present invention may include a filter circuit 50 between the Vcc terminal and a Vcc application node of the clock-data recovery circuit 30, and a filter circuit 52 between the GND terminal and a GND application node of the clock-data recovery circuit 30 as illustrated in FIG. 3.

The filter circuits 50 and 52 may include a low pass filter having a smoothing characteristic capable of reducing power noise. The filter circuits 50 and 52 may include an RC filter in which a resistor and a capacitor are combined in parallel to each other such that power noise is reduced. That is, the embodiment of FIG. 3 may be realized as illustrated in FIG. 4.

Figure 4:
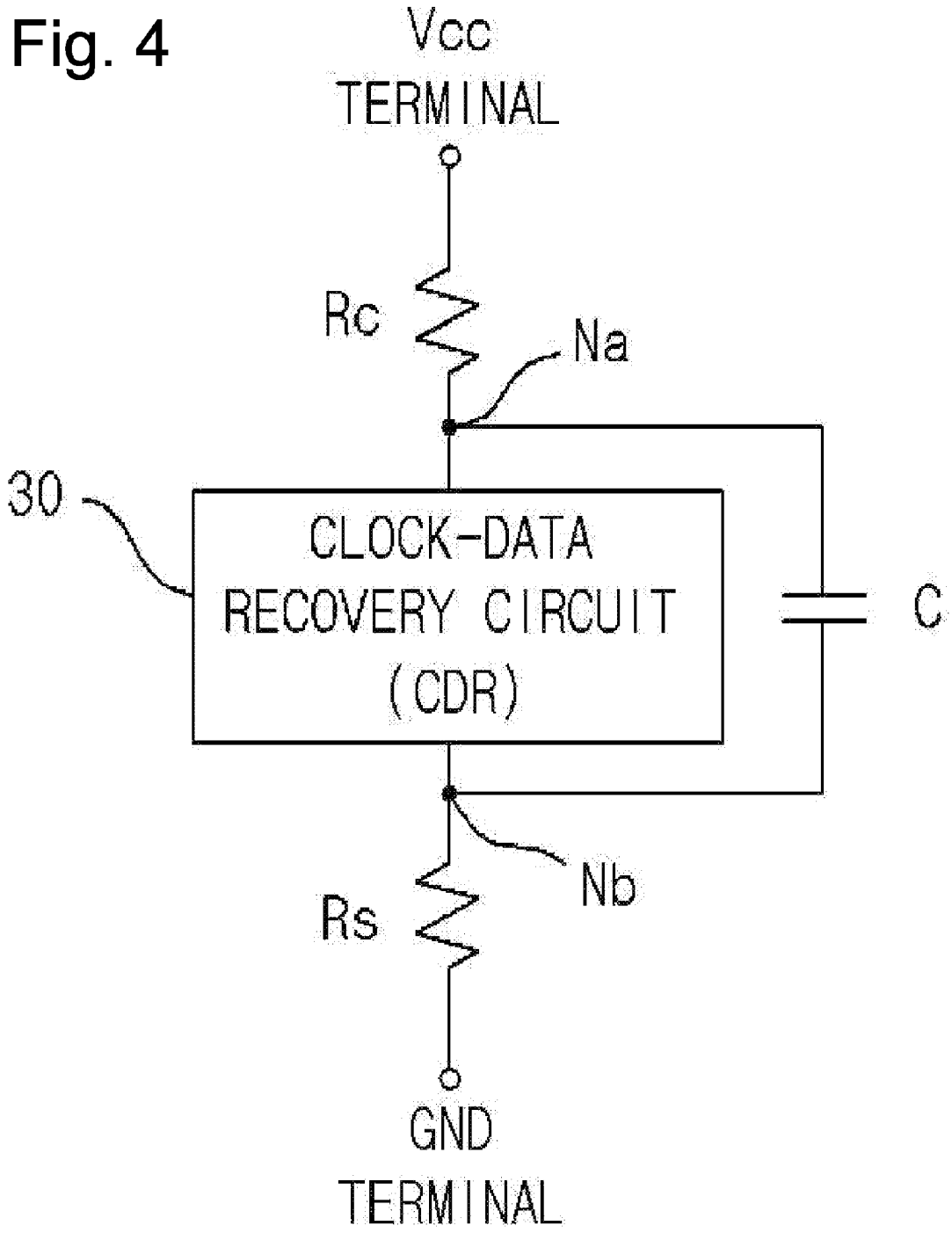
FIG. 4 to FIG. 6 are circuit diagrams illustrating detailed circuits of a modification of FIG. 3.

Referring to FIG. 4, a resistor Rc is provided between the Vcc terminal of the source driver 20 and the Vcc application node of the clock-data recovery circuit 30, a resistor Rs is provided between the GND terminal of the source driver 20 and the GND application node of the clock-data recovery circuit 30, and a capacitor C is provided in parallel to the clock-data recovery circuit 30. That is, the capacitor C is provided between the Vcc application node and the GND application node of the clock-data recovery circuit 30.

The filter circuit 50 may be realized by coupling the capacitor C and the resistor Rc to each other, and the filter circuit 52 may be realized by coupling the capacitor C and the resistor Rs to each other. That is, in the embodiment of the present invention, the filter circuit 50 and the filter circuit 52 may have a structure of sharing the capacitor C. The capacitor C may be configured using intrinsic capacitance of the clock-data recovery circuit 30.

In the embodiment of the present invention, it is the most effective that the filter circuits are provided to all the Vcc terminal and the GND terminal of the source driver 20 as illustrated in FIG. 3 and FIG. 4. However, in contrast to this, in the present invention, a filter circuit is provided to only one of the Vcc terminal and the GND terminal as illustrated in FIG. 5 or FIG. 6, so that it is possible to obtain an effect that power noise is blocked.

Figure 5:
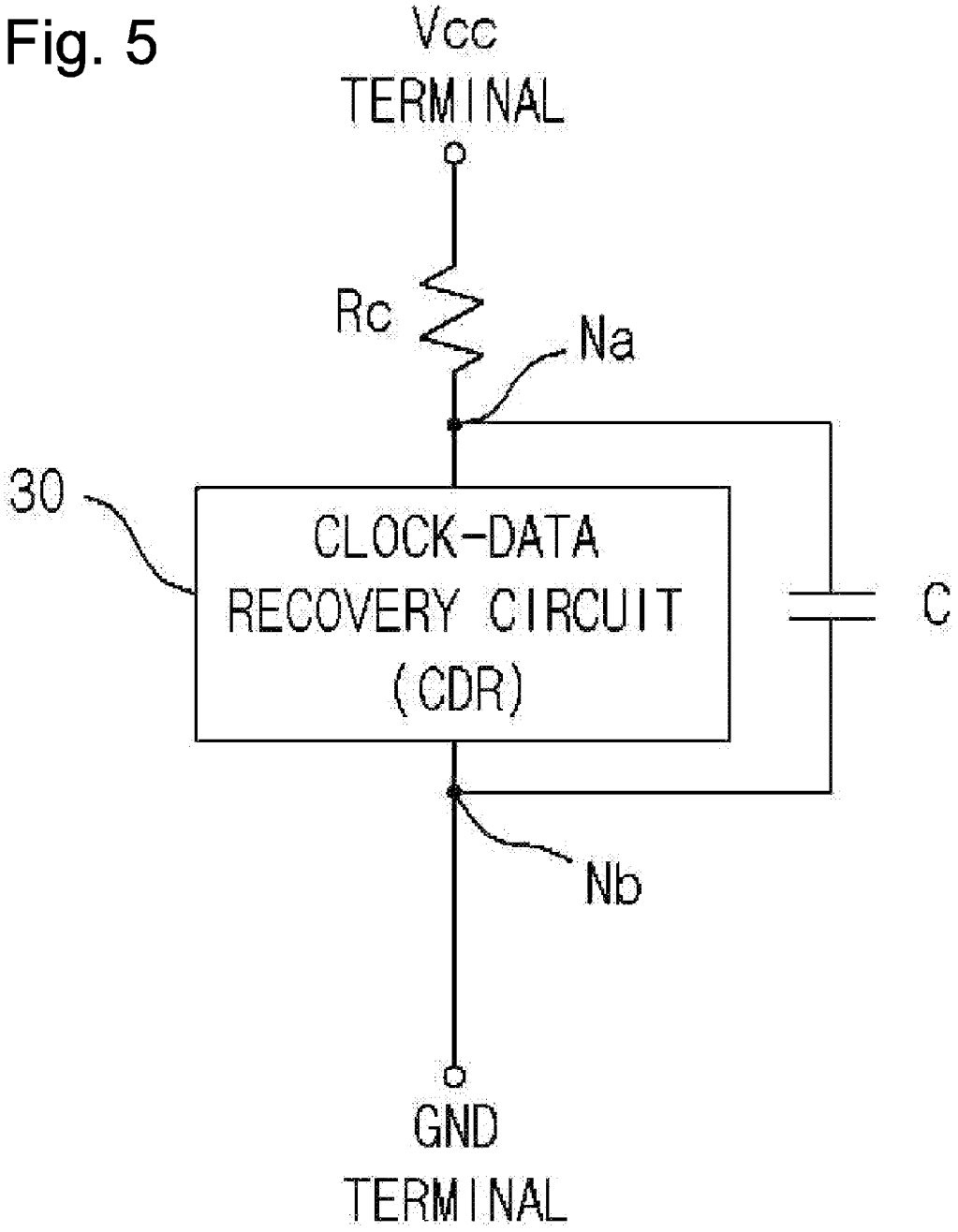
Figure 6:
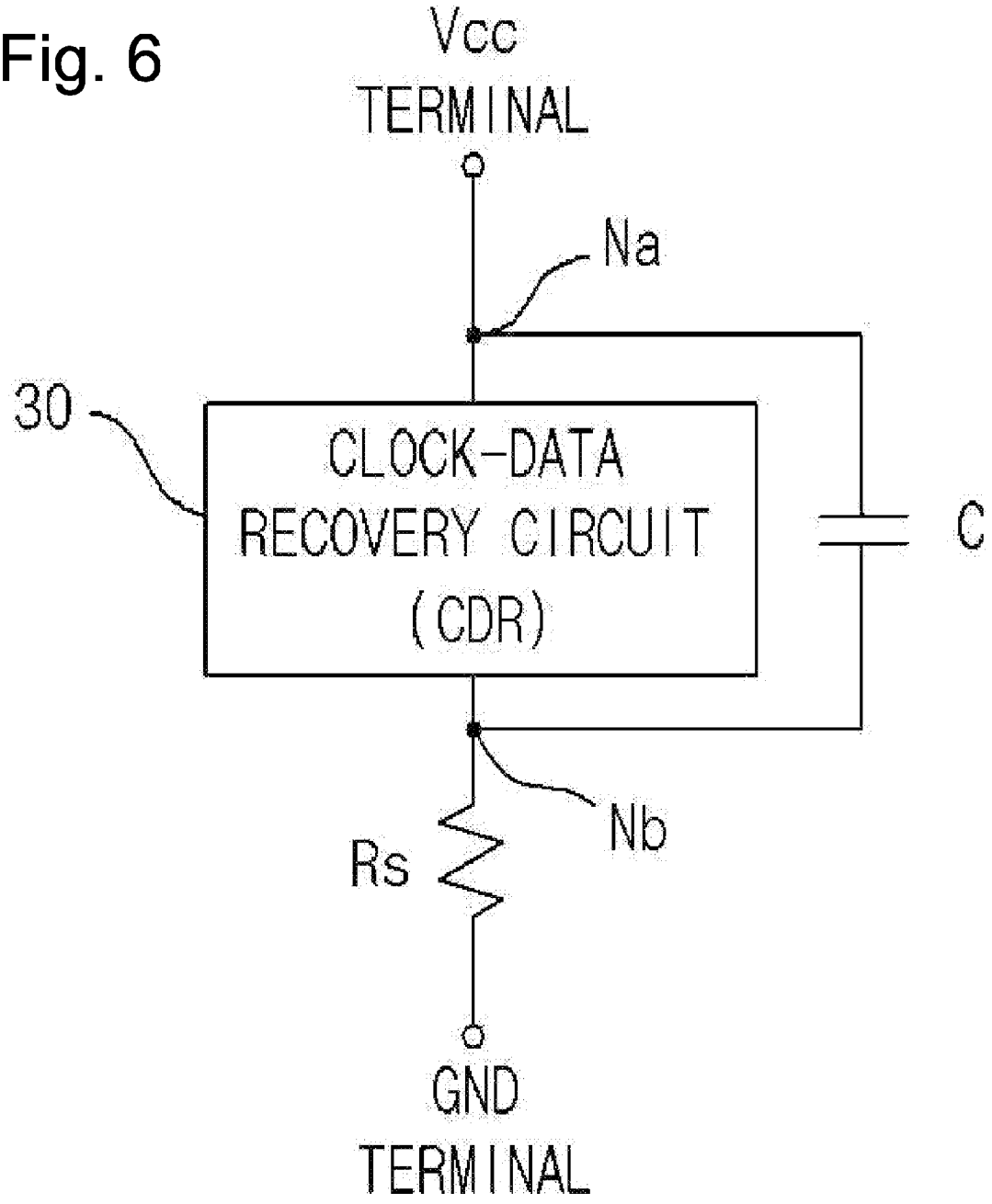

An embodiment of FIG. 5 is for preventing power noise from being introduced through the Vcc terminal, and an embodiment of FIG. 6 is for preventing power noise from being introduced through the GND terminal.

In FIG. 4 to FIG. 6, Na indicates the Vcc application node of the clock-data recovery circuit 30, and Nb indicates the GND application node of the clock-data recovery circuit 30.

In the aforementioned embodiment, the power noise may be introduced to at least one of the Vcc terminal and the GND terminal. The power noise may be attenuated by a low pass filtering effect due to the resistors Rc and Rs and the capacitor C of the filter circuit 50 or the filter circuit 52.

Accordingly, introduction of the power noise, which has been introduced to at least one of the Vcc terminal and the GND terminal, to the clock-data recovery circuit 30 through the Vcc application node Na or the GND application node Nb can be filtered.

According to the embodiment of the present invention, introduction of power noise to parts such as the clock-data recovery circuit 30 of the source driver 20 can be controlled. Consequently, the source driver 20 can have a characteristic insensitive to power noise, and can be prevented from performing an abnormal operation such as a data recognition error. Accordingly, an image can be normally outputted to the display panel 10.

Particularly, according to the present invention, when the clock signal and the data signal are transferred to the source driver through the single signal line as with the CED signal, lock fail can be prevented from occurring in the source driver by power noise occurring in an interior or an exterior. Accordingly, the source driver can normally perform clock recovery.

Furthermore, according to the present invention, even in the case of the source driver of the display apparatus that recovers the clock signal and the data signal by using the CED signal transmitted by the CEDS interface scheme and achieves a high speed operation and a large screen, the source driver can have a characteristic insensitive to power noise by the filtering function, and can stably operate.

Furthermore, in the embodiment of the present invention, the resistors Rc and Rs included in the aforementioned filter circuits 50 and 52 may use a metal resistor, a poly silicon resistor, a diffusion resistor and the like, so that it is possible to simplify the configuration of the source driver.

Figure 7:
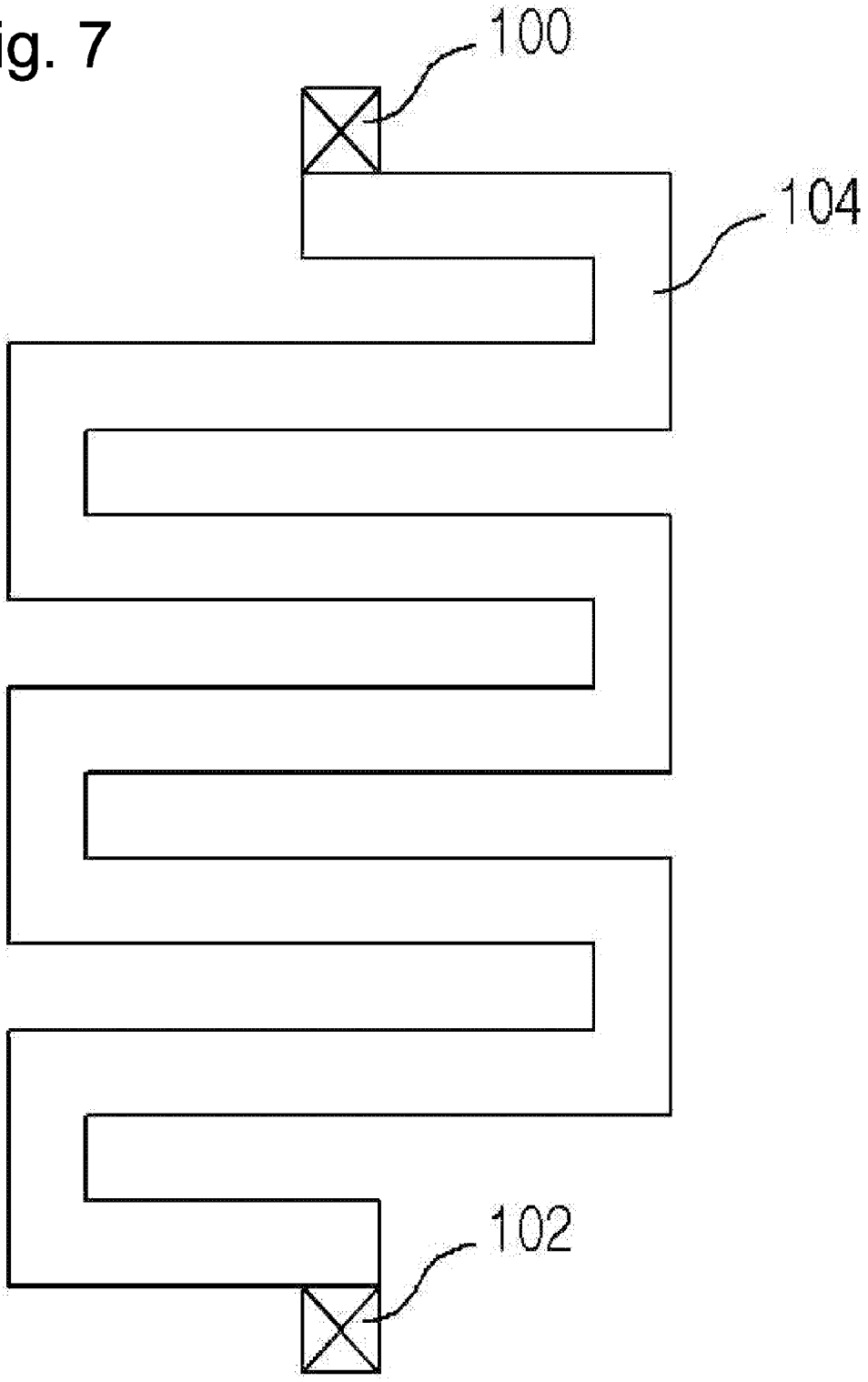
FIG. 7 is a layout diagram illustrating a method for forming a metal line in order to achieve resistors configured in FIG. 4 to FIG. 6.

The case of using the metal resistor as the resistors Rc and Rs of the filter circuits 50 and 52 may be illustrated in FIG. 7, and the resistors Rc and Rs may have a configuration in which a metal resistor 104 is connected between a terminal 100 and a terminal 102. The metal resistor 104, for example, may have a pattern with a serpentine shape in order to have a high resistance value, and this resistance value may be decided by an entire length and a width of the pattern. A material of the metal resistor 104 may be variously selected from metals including aluminum, an aluminum alloy, tungsten, a tungsten alloy, copper, a copper alloy, platinum, and gold according to the intention of a manufacturer.

Figure 8:
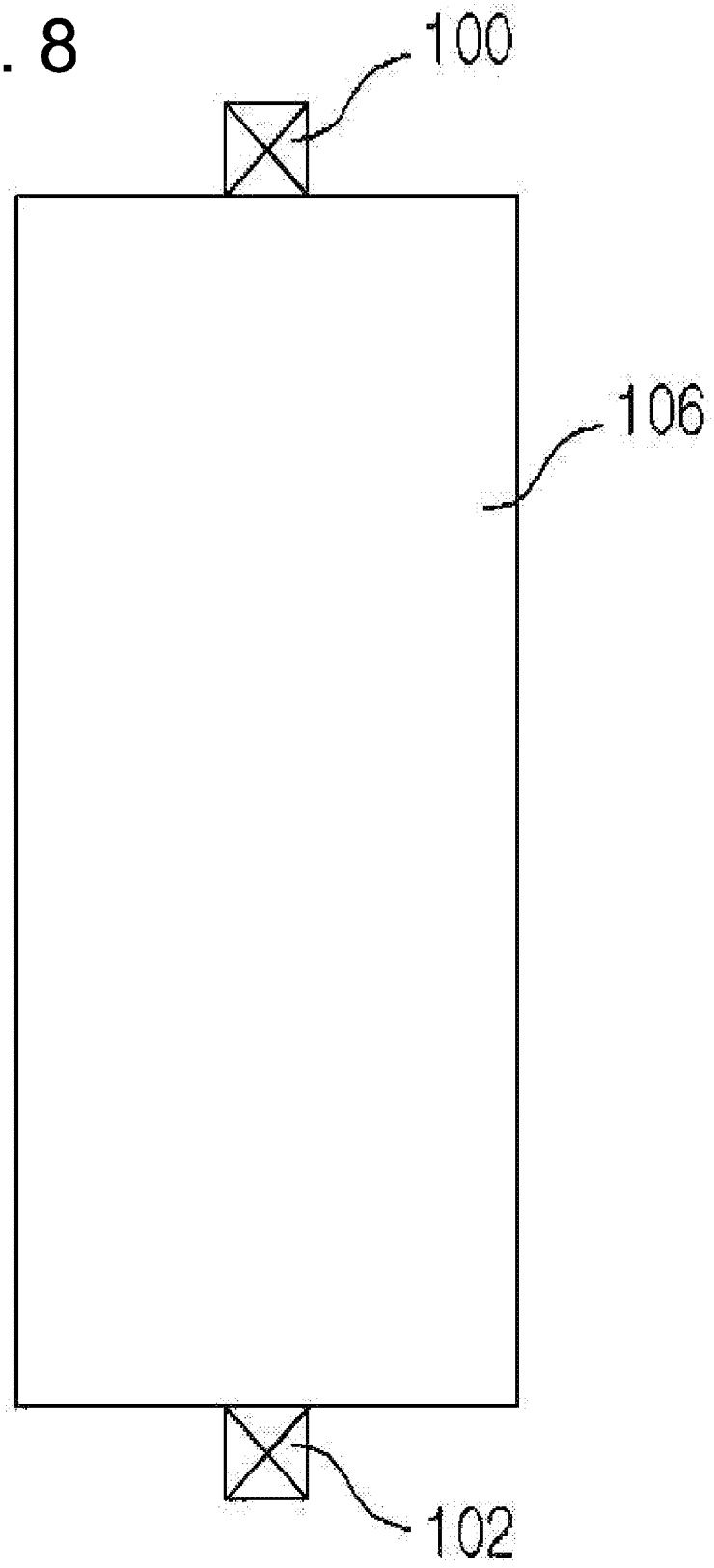
FIG. 8 is a layout diagram illustrating a method for forming a poly silicon line in order to achieve resistors configured in FIG. 4 to FIG. 6.

The case of using the poly silicon resistor as the resistors Rc and Rs of the filter circuits 50 and 52 may be illustrated in FIG. 8, and the resistors Rc and Rs have a configuration in which a poly silicon resistor 106 is connected between a terminal 100 and a terminal 102. The poly silicon resistor 106 may have a pad-shaped pattern having a predetermined area in order to have a high resistance value, and this resistance value may be decided by the area of the pattern. In the poly silicon resistor 106 of the embodiment of FIG. 8, the pattern is shaped like a rectangle.

Figure 9:
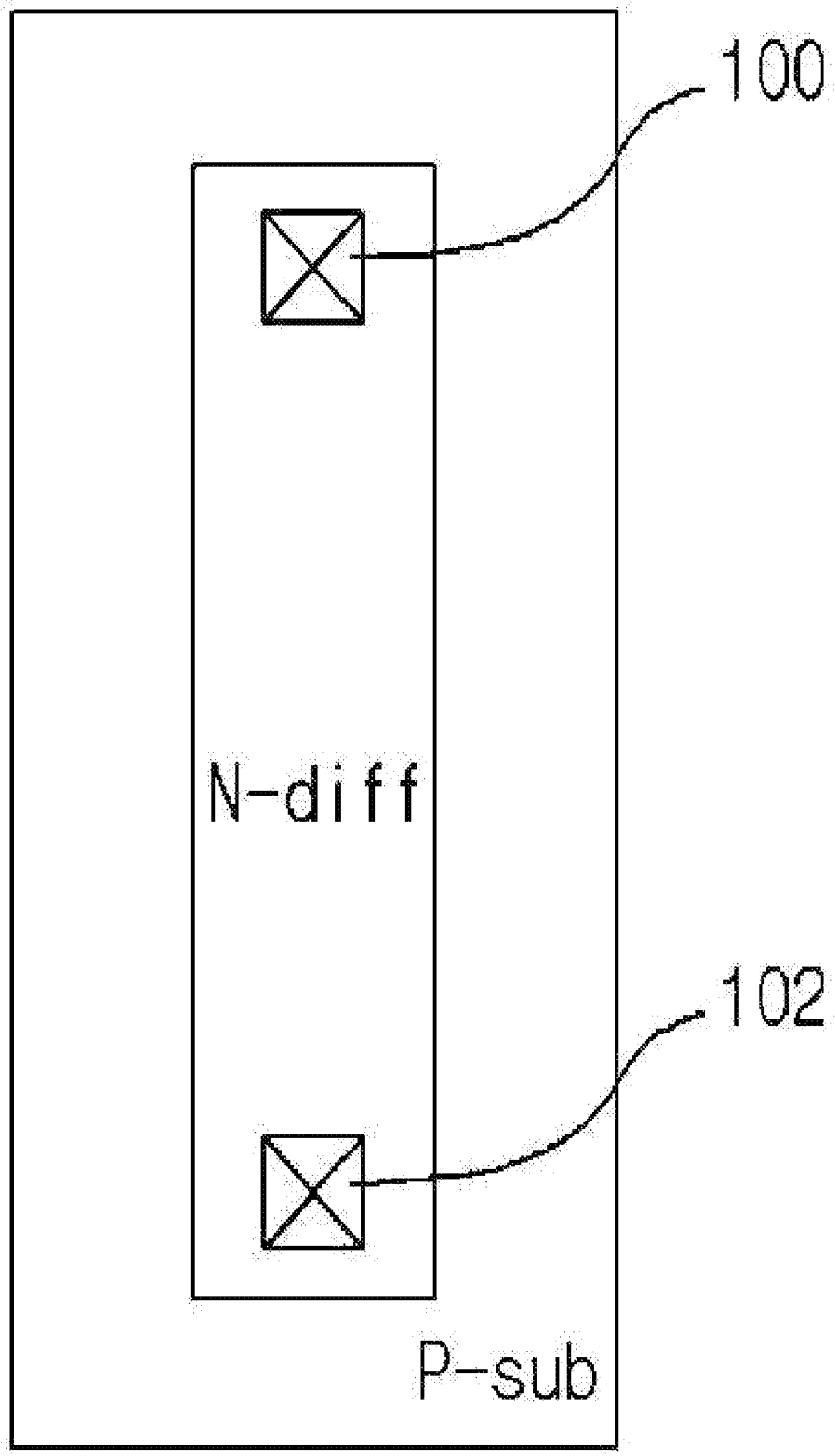
FIG. 9 is a layout diagram illustrating a method for forming a diffusion resistor in order to achieve resistors configured in FIG. 4 to FIG. 6.

The case of using the diffusion resistor as the resistors Rc and Rs of the filter circuits 50 and 52 may be illustrated in FIG. 9. The resistors Rc and Rs have a configuration in which a diffusion resistor N-diff is connected between a terminal 100 and a terminal 102. The diffusion resistor N-diff may have a bar or pad-shaped pattern having predetermined area and impurity concentration in order to have a high resistance value, and this resistance value may be decided by the area of the pattern constituting the diffusion resistor N-diff and the impurity concentration.

The diffusion resistor N-diff of the embodiment of FIG. 9 may be achieved by forming a N type diffusion area including N type impurities in a P type area P-sub. The N type diffusion area may be formed as a bar or pad-shaped pattern in order to serve as a resistor and may be formed by a typical diffusion process.

The P type area P-sub provides an isolation function for the diffusion resistor N-diff set by the N type diffusion area, and allows the diffusion resistor N-diff to have an insulating property with respect to a peripheral area. It is preferable that the P type area P-sub includes the N type diffusion area as with a well in which a P type impurity has been implanted or diffused.

The terminal 100 and the terminal 102 in FIG. 7 to FIG. 9 may include the Vcc terminal and the Vcc application node (or the node Na) of the clock-data recovery circuit 30 or the GND application node (or the node NB) of the clock-data recovery circuit 30 and the GND terminal. Furthermore, the terminal 100 and the terminal 102 in FIG. 7 to FIG. 9 may include electrical contacts formed in a layer different from that in which the metal resistor 104, the poly silicon resistor 106, or the diffusion resistor has been formed.

Figure 10:
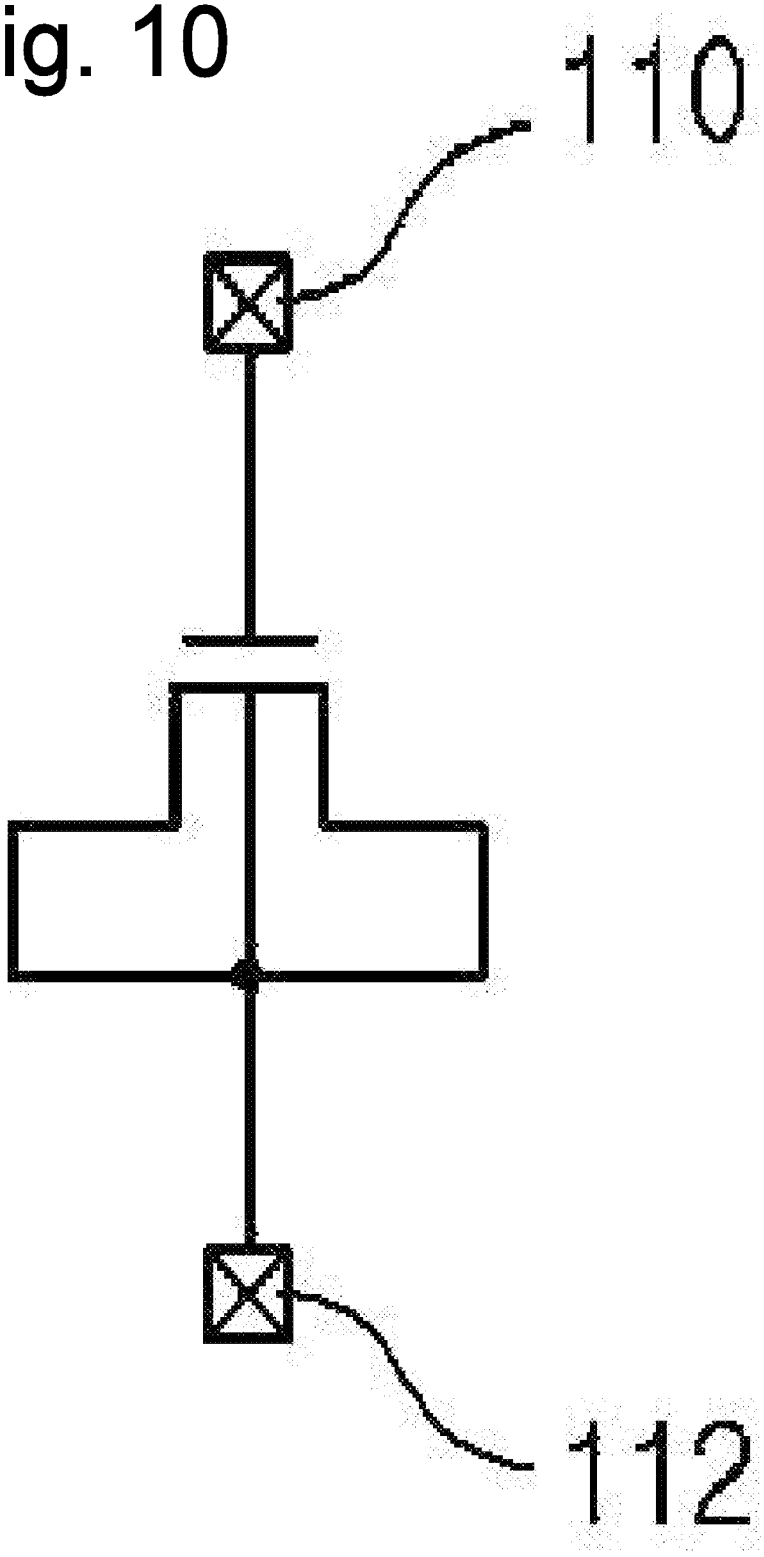
FIG. 10 is a circuit diagram illustrating a MOS capacitor configurable as an example of a capacitor configured in FIG. 4 to FIG. 6.
Figure 11:
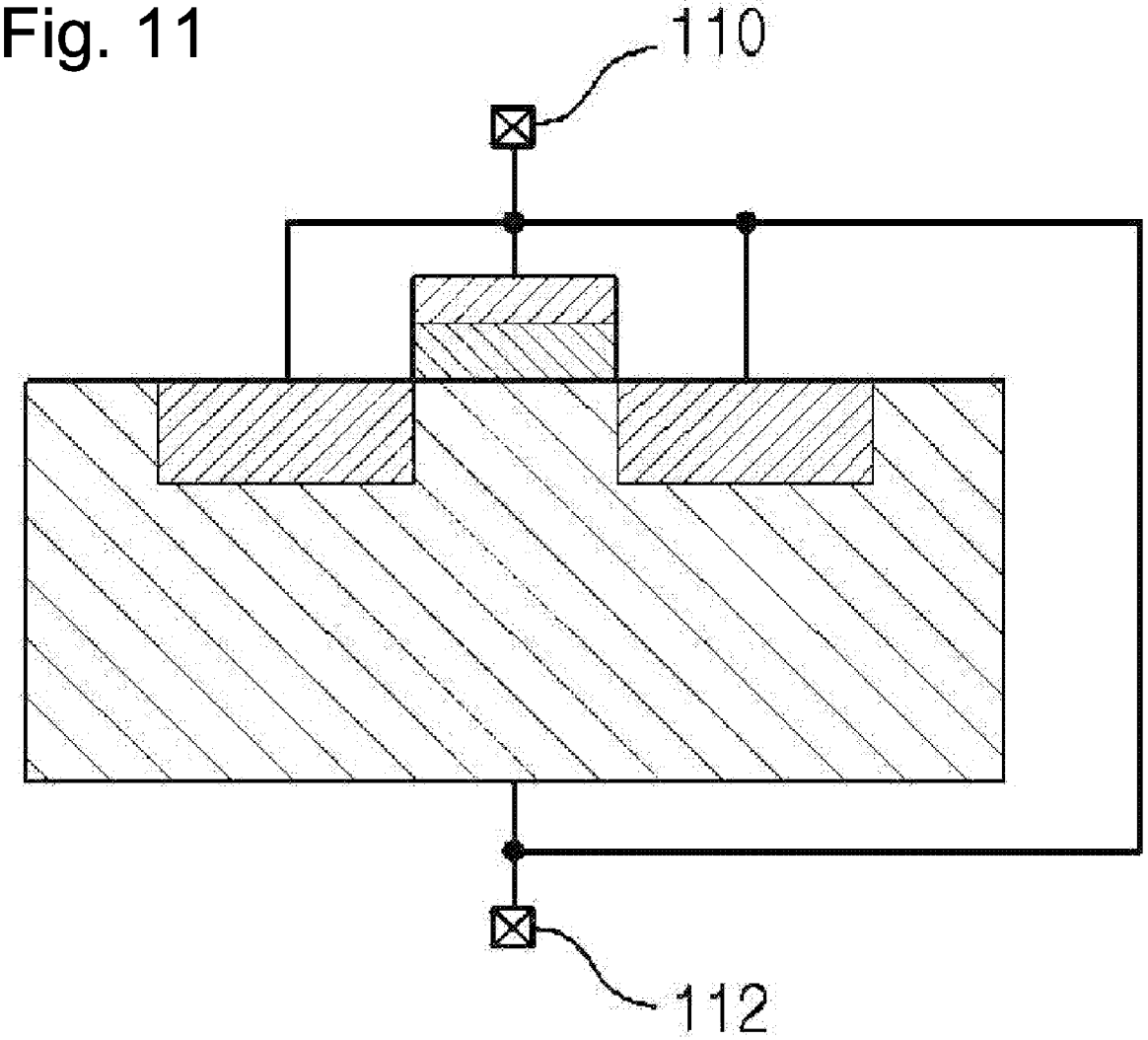
FIG. 11 is a sectional view for explaining the structure of a MOS capacitor of FIG. 10.
Figure 12:
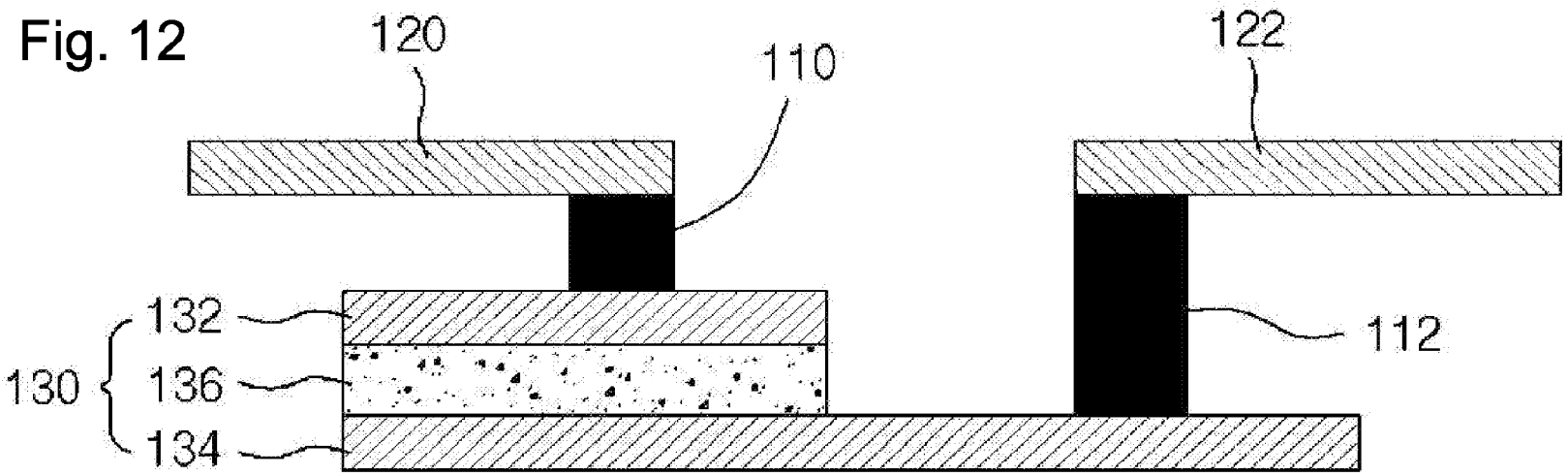
FIG. 12 is a sectional view of a MIM capacitor as an example of a capacitor configured in FIG. 4 to FIG. 6.

Furthermore, in the embodiment of the present invention, the capacitor C included in the filter circuits 50 and 52 may include a MOS (Metal Oxide Semiconductor) capacitor as illustrated in FIG. 10 and FIG. 11, or a MIM (Metal-Insulator-Metal) capacitor as illustrated in FIG. 12.

FIG. 10 illustrates an equivalent circuit of the MOS capacitor and FIG. 11 illustrates a sectional structure of the MOS capacitor.

In FIG. 10 and FIG. 11, a node 110 and a node 112 correspond to the Vcc application node Na and the GND application node Nb of the clock-data recovery circuit 30.

As seen from FIG. 10 and FIG. 11, the MOS capacitor has a structure in which a drain, a source, and a gate are commonly connected to one another, and the drain, the source, the gate, and a gate channel are commonly connected to one another, and has a capacitor characteristic by the aforementioned structural characteristic.

Furthermore, in the embodiment of the present invention, the capacitor C included in the filter circuits 50 and 52 may include a MIM (Metal-Insulator-Metal) capacitor as illustrated in FIG. 12.

Referring to FIG. 12, a MIM capacitor 130 has a configuration in which a dielectric layer 136 is formed between an upper electrode 132 and a lower electrode 134 which are stacked separately up and down, wherein the upper electrode 132 and the lower electrode 134 may be formed using a conductive material and the dielectric layer 136 may be formed using a dielectric such as an insulating oxide layer.

The MIM capacitor 130 is connected to interconnections 120 and 122 connected to the clock-data recovery circuit 30. In more detail, the interconnection 120 is connected to the upper electrode 132 formed as an upper layer through the Vcc application node 110 forming a contact, and is connected to the lower electrode 134 formed as a lower layer through the GND application node 112 forming another contact.

It is preferable that the interconnections 120 and 122 are formed on the same layer, and the Vcc application node 110 (that is, Na) and the GND application node 112 (that is, Nb) forming the contacts may be formed using via holes passing through an interlayer dielectric layer.

As described above, in the embodiment of the present invention, the resistors Rc and Rs and the capacitor C included in the filter circuits 50 and 52 can be simply provided in the source driver in order to perform a filtering function for power noise, and a resistance value and capacitance may be variously set.

Figure 13:
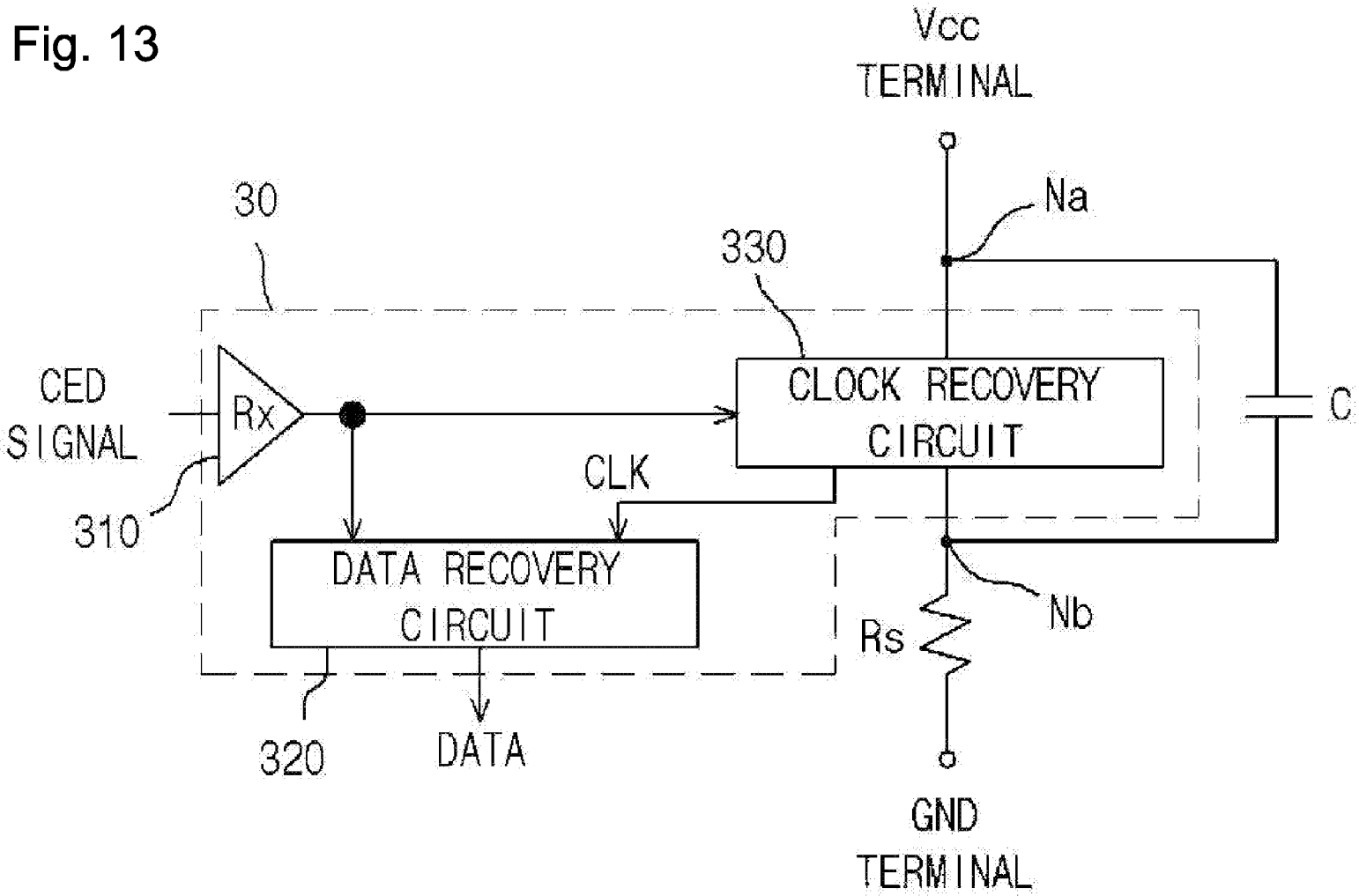
FIG. 13 is a block diagram illustrating another embodiment of the present invention.
Figure 14:
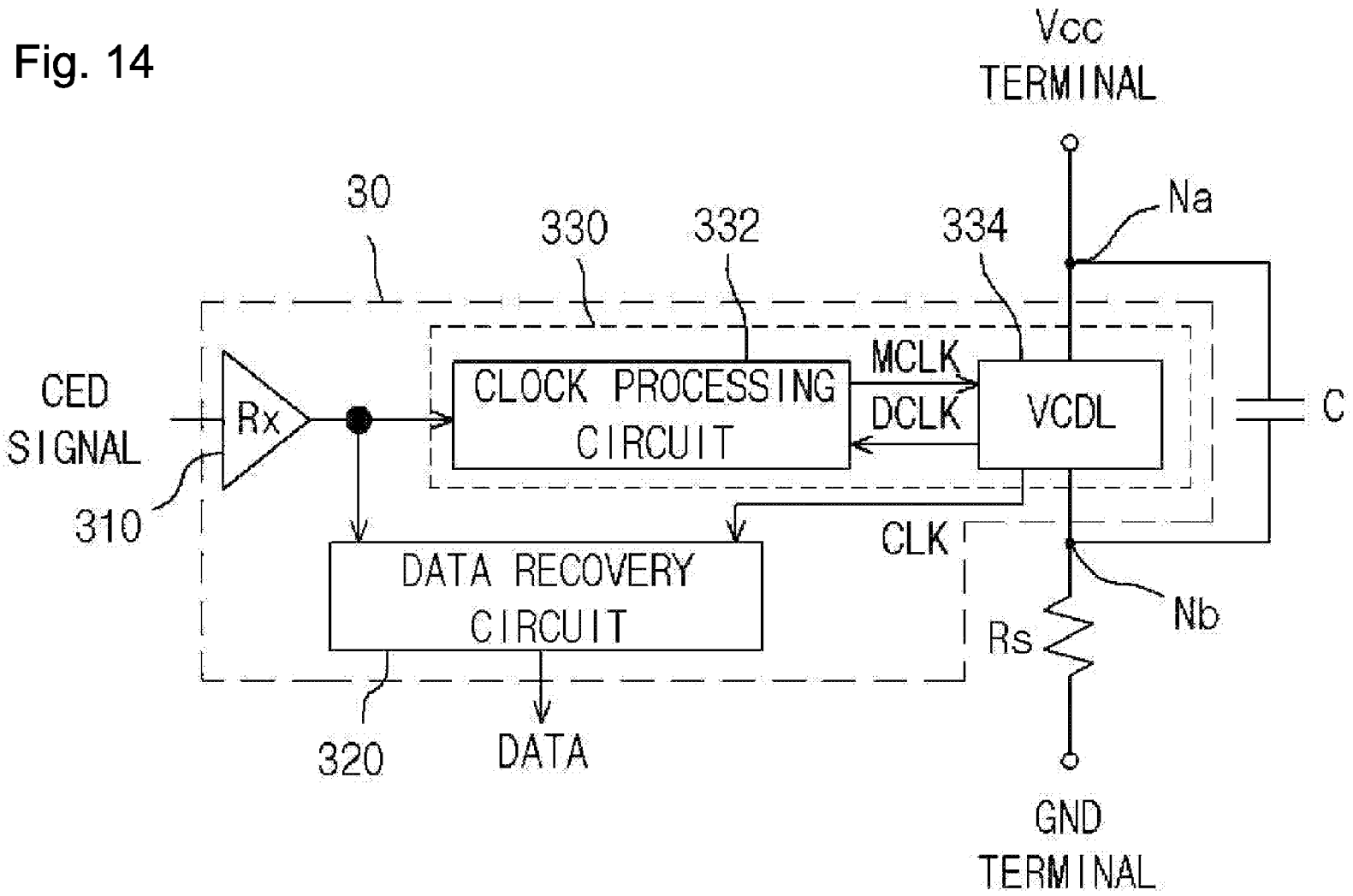
FIG. 14 is a block diagram illustrating further another embodiment of the present invention.

In the source driver 20 according to the embodiment of the present invention, as illustrated in FIG. 13 and FIG. 14, a filter for filtering power noise may be applied to a clock recovery circuit sensitive to power noise in the clock-data recovery circuit or a delay circuit in the clock recovery circuit. FIG. 13 illustrates an embodiment in which the filter is applied to the clock recovery circuit in the clock-data recovery circuit 30, and FIG. 14 illustrates an embodiment in which the filter is applied to the delay circuit in the clock recovery circuit.

Referring to FIG. 13, the clock-data recovery circuit 30 includes a reception unit (Rx) 310, a data recovery circuit 320, and a clock recovery circuit 330.

The reception unit 310 receives the CED signal, amplifies the CED signal, and provides the amplified CED signal to the data recovery circuit 320 and the clock recovery circuit 330. The data recovery circuit 320 recovers a data signal from the CED signal by using a clock signal CLK of the clock recovery circuit 330, and outputs the recovered data signal. The clock recovery circuit 330 recovers a clock signal included in the CED signal, and provides the recovered clock signal to the data recovery circuit 320.

In the embodiment of the present invention, as illustrated in FIG. 13, it is possible to exclude the application of the filter circuit for filtering power noise to an element that needs to ensure an operation voltage margin among the elements of the clock-data recovery circuit 30. The clock recovery circuit 330 is insensitive to the operation voltage margin as compared with the data recovery circuit 320. Consequently, it is possible to exclude the application of the filter circuit to the data recovery circuit 320, and it is possible to apply the filter circuit to the clock recovery circuit 330.

In the embodiment of FIG. 13, the filter circuit corresponding to the embodiment of FIG. 6 is applied. However, the present invention is not limited thereto. For example, the filter circuit corresponding to the embodiment of FIG. 4 or FIG. 5 may be applied.

The elements of the clock recovery circuit 330 may be classified into elements that need to ensure the operation voltage margin and elements that are insensitive to the operation voltage margin. In this case, the filter circuit may be applied to the elements insensitive to the operation voltage margin, and an embodiment for this case may be illustrated in FIG. 14.

Since the embodiment of FIG. 14 illustrates detailed blocks of the clock recovery circuit 330 in the embodiment of FIG. 13, a description of elements of FIG. 14 equal to those of FIG. 13 will be omitted in order to avoid redundancy.

The clock recovery circuit 330 includes a clock processing unit 332 and a delay circuit 334. FIG. 14 illustrates an example in which the delay circuit 334 includes a voltage controlled delay line (VCCL). The voltage controlled delay line includes a delay unit chain and has a configuration in which a delay time of each delay unit is controlled by a biased voltage level.

The clock processing unit 332 receives the CED signal, compares the clock signal included in the CED signal with a delayed clock signal DCLK provided by the delay circuit 334, and provides a recovered master clock signal MCLK to the delay circuit 334. In the case in which the clock signal CLK is not stable, the clock processing unit 332 performs clock training until a lock state is reached and provides the master clock signal MCLK. In the case of the lock state in which the clock signal CLK is stable, the clock processing unit 332 completes the clock training, performs clock recovery, and provides the master clock signal MCLK.

The delay circuit 334 includes the delay unit chain including a plurality of delay units (not illustrated), and the master clock signal MCLK is delayed by the delay unit chain. The delay circuit 334 may generate the delayed clock signal DCLK for each delay unit on the delay unit chain. The delay circuit 334 may provide a part selected from the delayed clock signals for each delay unit to the clock processing unit 332 as the delayed clock signal DCLK. Furthermore, the delay circuit 334 may provide one selected from the delayed clock signals for each delay unit to the data recovery circuit 320 as a recovered clock signal CLK.

In the embodiment of the present invention, as illustrated in FIG. 14, it is possible to exclude the application of the filter circuit for filtering power noise to an element that needs to ensure the operation voltage margin among the elements of the clock recovery circuit 330. The delay circuit 334 is insensitive to the operation voltage margin as compared with the clock processing unit 332. Consequently, it is possible to exclude the application of the filter circuit to the clock processing unit 332, and it is possible to apply the filter circuit to the delay circuit 334.

In the embodiment of FIG. 14, the filter circuit corresponding to the embodiment of FIG. 6 is applied. However, the present invention is not limited thereto. For example, the filter circuit corresponding to the embodiment of FIG. 4 or FIG. 5 may be applied.

As described above, in the embodiments of the present invention, the filtering function for power noise may be limitedly provided to a part of the elements of the clock-data recovery circuit 30 or a part of the elements of the clock recovery circuit 330. Consequently, it is possible to perform filtering for power noise while ensuring an operation margin of the clock-data recovery circuit 30 or the clock recovery circuit 330.

Although a preferred embodiment of the present invention has been described for illustrative purposes, those skilled in the art will appreciate that various modifications, additions and substitutions are possible, without departing from the scope and the spirit of the invention as disclosed in the accompanying claims.

What is claimed is:

1. A source driver for a display apparatus comprising:

a clock-data recovery circuit that receives a clock signal and a data signal through a single signal line, recovers the clock signal and the data signal, and comprises a clock recovery circuit including a clock processing unit and a delay circuit, which the delay circuit is insensitive to an operation voltage margin as compared with the clock processing unit; and a filter circuit that is connected to at least one of an operation voltage application mode and a ground voltage application node of the delay circuit, filters transfer of power noise occurring in an interior or an exterior of the source driver to the delay circuit, and prevents lock fail from occurring in the clock-data recovery circuit of the source driver by the power noise, wherein an output of the filter circuit is provided through the voltage application node of the delay circuit.

2. The source driver for a display apparatus according to claim 1, wherein the clock-data recovery circuit receives the clock signal and the data signal having a same amplitude through the single signal line, and the clock signal periodically exists and has been embedded in the data signal.

3. The source driver for a display apparatus according to claim 1, wherein the filter circuit is provided between an operation voltage terminal of the clock-data recovery circuit and the operation voltage application node of the delay circuit.

4. The source driver for a display apparatus according to claim 1, wherein the filter circuit is provided between a ground voltage terminal of the clock-data recovery circuit and the ground voltage application node of the delay circuit.

5. The source driver for a display apparatus according to claim 1, wherein the filter circuit includes an RC filter.

6. The source driver for a display apparatus according to claim 5, wherein the filter circuit is configured using intrinsic capacitance of the clock-data recovery circuit.

7. The source driver for a display apparatus according to claim 1, wherein the filter circuit includes a low pass filter.

8. The source driver for a display apparatus according to claim 1, wherein the filter circuit comprises:

a first filter circuit provided between an operation voltage terminal of the clock-data recovery circuit and an operation voltage application node of the delay circuit; and a second filter circuit provided between a ground voltage terminal of the clock-data recovery circuit and a ground voltage application node of the delay circuit.

9. The source driver for a display apparatus according to claim 8, wherein the first filter circuit and the second filter circuit share a capacitor provided in parallel to the delay circuit.

10. The source driver for a display apparatus according to claim 1, wherein the filter circuit includes a resistor including one of a metal resistor, a poly silicon resistor, and a diffusion resistor.

11. The source driver for a display apparatus according to claim 1, wherein the filter circuit includes a capacitor including one of a MOS capacitor and a MIM capacitor.

12. The source driver for a display apparatus according to claim 1, wherein the clock-data recovery circuit receives a signal in which the clock signal has been embedded in the data signal.

13. A source driver for a display apparatus comprising:

at least one voltage terminal;

a circuit that comprises a clock recovery circuit including a clock processing unit and a delay circuit, which the delay circuit is insensitive to a operation voltage margin as compared with the clock processing unit and receives a signal including a clock signal and performs a preset operation by using the clock signal; and a filter circuit that is connected between the voltage terminal of the source driver and the delay circuit, filters transfer of power noise occurring in an interior or an exterior of the source driver to the delay circuit through the voltage terminal, and prevents lock fail from occurring in the clock-data recovery circuit of the source driver by the power noise, wherein an output of the filter circuit is provided through a voltage application node of the delay circuit.

14. The source driver for a display apparatus according to claim 13, wherein the delay circuit includes a voltage controlled delay line.

15. The source driver for a display apparatus according to claim 13, wherein the filter circuit includes an RC filter or a low pass filter.

16. The source driver for a display apparatus according to claim 13, wherein the filter circuit is configured using intrinsic capacitance of the circuit.

17. A source driver integrated circuit for a display apparatus comprising:

a semiconductor substrate;

layers deposited over the semiconductor substrate and patterned to form, at least, the following:

a clock-data recovery circuit that receives a clock signal and a data signal through a single signal line, recovers the clock signal and the data signal, and comprises a clock recovery circuit including a clock processing unit and a delay circuit, which the delay circuit is insensitive to a operation voltage margin as compared with the clock processing unit; and a filter circuit that is connected to at least one of an operation voltage application node and a ground voltage application node of the delay circuit, filters transfer of power noise occurring in an interior or an exterior of the source driver to the clock-data recovery circuit, and prevents lock fail from occurring in the clock-data recovery circuit of the source driver by the power noise, wherein an output of the filter circuit is provided between the operation voltage application node of the delay circuit and the ground voltage application node of the delay circuit.

* * * * *